United States Patent [19]

Wroblewski

[11] 3,987,339

[45] Oct. 19, 1976

[54] CONSTANT POWER LAMP BALLAST

[75] Inventor: Theodore Wroblewski, Danvers, Mass.

[73] Assignee: Frequency Technology, Inc., Littleton, Mass.

[22] Filed: Dec. 10, 1975

[21] Appl. No.: 639,464

[52] U.S. Cl. ..... 315/278; 315/239; 315/282; 336/165

[51] Int. Cl.[2] ..... H05B 41/16

[58] Field of Search ..... 315/239, 276, 278, 282, 315/291, DIG. 5; 336/165

[56] References Cited

UNITED STATES PATENTS

| | | | |
|---|---|---|---|
| 2,462,371 | 2/1949 | Engle | 315/282 X |
| 2,821,661 | 1/1958 | Bastian | 315/282 X |
| 2,880,374 | 3/1959 | Mulder | 315/278 X |
| 3,022,458 | 2/1962 | Sola | 315/282 X |
| 3,684,921 | 8/1972 | DeLeon | 315/276 |

*Primary Examiner*—Eugene La Roche
*Attorney, Agent, or Firm*—Cesari and McKenna

[57] ABSTRACT

A ballast circuit for providing constant power to a high intensity discharge lamp, the ballast including a transformer having two cores separated by a gap, one core being at least partially closed and the other, having an air gap. A primary coil winds around a portion of each core and secondary coils wind around another portion of each core. The secondary coils and a capacitor are in series with the lamp to regulate the current and voltage applied to the lamp.

2 Claims, 1 Drawing Figure

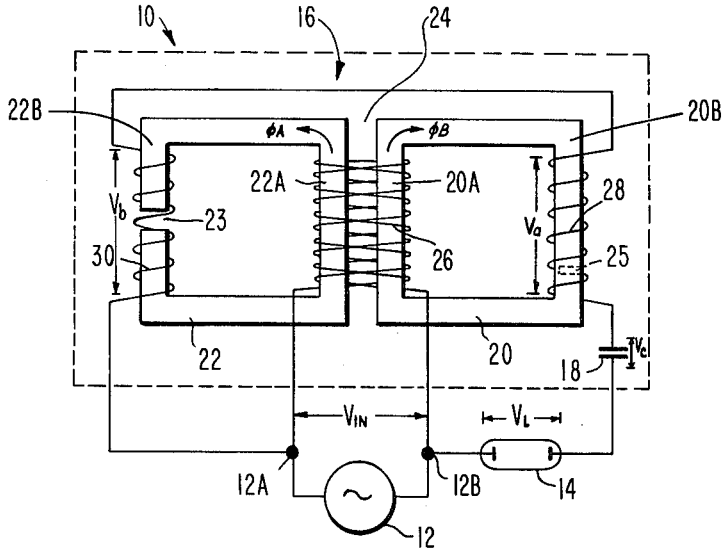
THE FIGURE

CONSTANT POWER LAMP BALLAST

BACKGROUND OF THE INVENTION

The present invention relates to ballast circuits for high intensity discharge lamps or any arc lamps (e.g., flourescent) and, more specifically, to lead ballasts for use with such lamps.

High intensity discharge lamps are popularly used because of their efficiency and daylight-spectrum light capability. Such lamps usually include a partially evacuated tube containing a gas such as sodium vapor. Two electrodes within the tube apply a voltage across the gas and thereby ionize it. The ionized gas glows as it conducts current. Lamps of this type initially have a very high impedance (before the gas ionizes) and require a high start up voltage. However, once the lamp has ignited, i.e. the gas has ionized, the voltage across the lamp drops sharply during a warm-up period. As the lamp warms up, during a three to ten minute period, its voltage rises until it reaches a stable operating level.

As a result of the voltage-current characteristics of these lamps, it is not practical to connect them directly to a voltage source, since the current through the lamps would damage the lamps and/or the power source. Consequently, circuitry is needed which provides a high ignition voltage to the lamp and which also limits the current through the lamp during its warm-up period.

Other characteristics of discharge lamps should also be considered when providing a lamp circuit. For example, lamp life is prolonged if the crest factor, or ratio of the maximum versus the average current applied to the lamp, is kept low. In addition, as the lamp ages, its voltage increases. The current supplied to the lamp should then decrease to maintain a constant power level to the lamp. To maintain efficiency of the system, the power factor of the power supplied to the lamp should be as near unity as possible. Finally, the lamp circuit should compensate for variations in supply voltage.

Various types of current-limiting circuits, or ballasts, are well known in the art for use with high intensity discharge lamps. The ballasts currently known include one resistive type and two reactive types. The reactive types are further classified according to whether they are lead or lag ballasts, i.e., whether they cause the current to lead or lag the voltage.

A resistive ballast circuit comprises a resistor in series with the lamp and the power supply so that the resistance of the ballast limits the current through the lamp during the lamp warm-up period. However, these ballasts dissipate a considerable amount of energy during normal operation of the lamp and consequently are not suitable for use in many cases.

The lag ballast usually comprises an inductor in series with the lamp circuit and a capacitor connected, for power factor correction, across the lamp-inductor combination. The term lag refers to the predominantly inductive nature of the lamp circuit. More specifically, in operation, the lag ballast inductance limits current through the lamp without, itself, dissipating much power. For normal operating conditions the lag ballast impedance is usually approximately equal to the lamp impedance and the supply voltage is equally distributed between them.

A problem inherent in lag ballasts occurs during warmup, when the lamp impedance decreases and most of the supply voltage is across the ballast. The current through the ballast now increases and may cause it to saturate, thereby allowing a further current increase which may be harmful to the lamp, ballast, and power supply. Thus, the lag ballast must be physically large to prevent saturation during warmup. Further, the reactance of the ballast must be high to adequately limit the lamp current during warm up.

A typical lead ballast currently known in the art includes an inductor and capacitor which are both in series with the lamp and the power source. The impedance of the ballast in this case is the difference between the inductive reactance and the capacitive reactance. The high current during the initial warm-up period saturates the inductor and the series reactance of the inductor and capacitor combination thus increases to limit the current through the lamp. After the lamp warms-up and the inductor unsaturates, the impedance of the ballast decreases but remains considerably higher than the lamp impedance.

There are several problems associated with conventional lead ballasts. In particular, the ballast tends to function as a constant current source which maintains an essentially constant current through the lamp despite lamp voltage variations due to ageing. Consequently, the power to the lamp increases as the lamp ages which shortens its life and changes the color of its light.

The inductor of a lead ballast may be a transformer secondary winding which increases the voltage across the lamp during warm-up. Unfortunately, this arrangement multiplies any changes in the power supply voltage variation and amplifies changes in lamp current which, in turn, shortens the lamp life.

SUMMARY OF THE INVENTION

It is an object of this invention to provide a ballast circuit which applies constant power to a high intensity discharge lamp.

It is a further object of this invention to provide a ballast circuit which improves the power factor of power supplied to a high intensity discharge lamp.

Another object of the invention is to provide a ballast circuit to regulate the voltage applied to a high intensity discharge lamp.

In accordance with the above objects, I provide a high intensity discharge lamp ballast circuit having a transformer with a partially closed first core and a second core which has an air gap and is spaced from the first core. A primary winding around the juxtaposed legs of the first and second cores receives an unregulated supply voltage and induces a magnetic flux in both cores. First and second secondary coils are arranged around the first and second coils, respectively. The ballast circuit comprises secondary windings and a capacitor which are connected in series with the high intensity discharge lamp and the power source.

During warm-up, when the lamp impedance is low, the high current through the secondary coils saturates the first coil and consequently reduces its inductance increasing the overall impedance of the ballast circuit. Thus, the current is limited to a predetermined value by the impedance of the ballast. As the lamp impedance increases, the first core unsaturates and the ballast impedance lowers to approximately equal the lamp impedance. The ballast regulates the voltage applied to the lamp by switching the flux in the cores to oppose variations in supply voltage. The transformer action of the windings provides a high voltage to the lamp during ignition.

BRIEF DESCRIPTION OF THE DRAWINGS

The FIGURE is a drawing of the ballast circuit of the present invention.

DESCRIPTION OF THE PREFERRED EMBODIMENT

The FIGURE depicts a lighting system using the present invention including a ballast circuit 10 connected to an unregulated source of AC power 12. The ballast circuit 10 connects to a high intensity discharge (HID) lamp 14. The ballast circuit 10 includes a transformer 16 and a capacitor 18. The transformer includes a closed core 20 and a core 22 having a gap 23. The core 20 may have a partial spline gap 25. The cores 20 and 22 have vertical legs 20A and 20B and 22A and 22B, respectively. Legs 20A and 22A are separated by a gap 24 and are enclosed by a primary coil 26 which connects to the power supply 12 at terminals 12A and 12B. Secondary coils 28 and 30 wind around legs 20B and 22B, respectively.

The coils 28 and 30 are in series with capacitor 18 and lamp 14 between terminals 12A and 12B. A voltage $V_{in}$ between terminal 12A and 12B causes a current $I_{in}$ in the coil 26. $I_{in}$, in turn, induces fluxes $\phi_a$ and $\phi_b$ in cores 20 and 22 respectively. These fluxes induce voltages $V_a$ and $V_b$ across the coils 28 and 30 respectively. Consequently, a voltage $V_L$ is applied across the lamp 14 such that: $V_L = V_{in} - V_c + V_a - V_b$ (where $V_c$ is the voltage across the capacitor 18).

When $V_{in}$ is within normal limits and the lamp 14 is at its normal operating voltage, $\phi_a$ is much greater than $\phi_b$ because of the much higher initial reluctance of core 22 due to gap 23. However, during the lamp 14 warmup period the low impedance of the lamp 14 allows an increased current to flow through secondary coils 28 and 30. Consequently, during warmup, $I_{in}$ begins to increase and, accompanying, $\phi_a$ begins to increase. The core 20 saturates thereby sharply reducing the inductance of coil 28. The present ballast circuit 10 now performs in a manner similar to conventional lead ballasts in that the reduced inductance of coil 28 greatly increases the combined impedance of the coils 28 and 30 and the capacitor 18 which limits the current through the lamp 14.

During normal operating conditions when the impedance and the voltage of the lamp 14 increases to its steady operating level, the core 20 unsaturates thereby increasing the reactance of coil 28, and decreasing the combined impedance of the coils 28 and 30 and capacitor 18 to approximately the impedance of the lamp 14. The relatively low impedance of the present ballast circuit when compared with prior lead ballasts has the advantage that, as the lamp 14 ages and $V_L$ increases the current through the lamp 14 decreases to partially regulate the lamp power.

The crest factor of the power supplied to the lamp during normal operation is typically 1.5 and the power factor is 0.6, both of which are improvements over similar factors for many prior lead ballasts.

The ballast of the present invention also serves to regulate the voltage applied to the lamp 14 despite variations in the supply voltage $V_{in}$. The voltage regulating properties of the present invention may be more fully understood when read in combination with my co-pending application for a VOLTAGE REGULATING TRANSFORMER, filed July 23, 1975, Serial No. 598,270, which is expressly incorporated by reference herein.

As noted above, the reluctance of the magnetic circuit comprising core 22 and gap 23 is considerably higher than the reluctance of the closed magnetic circuit 20. Thus, as $\phi_{in}$ changes, $\phi_a$ tends to lead $\phi_b$ in time. After core 20 saturates, however, flux $\phi_b$ accounts for substantially all further increases in $\phi_{in}$. Since $\phi_{in} = \phi_a + \phi_b$, $\phi_b$ varies in amplitude and phase with relation to $\phi_a$ so as to assist in maintaining the magnitude $\phi_a$ constant with variations in $\phi_{in}$. Further, as $\phi_b$ increases, $V_b$ increases to oppose changes in $V_{in}$. Thus, the voltage across the lamp 14 remains essentially constant with variations in $V_{in}$.

A lamp ballast made in accordance with the present invention for a 400 watt HID lamp may be comprised as follows:

Primary coil - 189 turns
Secondary coil 28 - 280 turns
Secondary coil 30 - 160 turns
cores 20 and 22 - UI 75 1.75 inch stack
gap 23 - 0.030 inches
capacitor 18 - 50 uf It will be clear to those skilled in the art that various changes may be made from the foregoing without departing from either the spirit or the scope of the invention and it is intended that such changes be encompassed herein.

Wherefore I claim:

1. A ballast for a high intensity discharge lamp said ballast and lamp connected across a supply voltage, and said ballast comprising:

A. first and second permeable magnetic cores said cores being spaced by an air gap, said first core comprising a closed magnetic circuit, and said second core having an air gap, B. a primary winding for connection to a source of alternating current of fluctuating voltage, said primary winding arranged around a portion of both said cores for inducing magnetic fluxes therein, C. a first secondary winding arranged around a portion of said first core and a second secondary winding arranged around a portion of said second core, so that a voltage is induced in each of said secondary windings by the magnetic flux, said secondary windings connected in series with said lamp, and the voltage induced in said second secondary winding varying to oppose the voltage fluctuations.

D. a capacitor in series with said secondary windings the impedance of said secondary windings and said capacitor regulating the current through said lamp.

2. A ballast as defined in claim 1 further comprising a gap partially through said first core for decreasing the saturation flux of that core.

* * * * *